United States Patent [19]

Burger et al.

[11] 4,003,829

[45] Jan. 18, 1977

[54] METHOD OF REMOVING CONTAMINANT FROM A HYDROCARBONACEOUS FLUID

[75] Inventors: Edward D. Burger; Daniel J. Curtin, both of Plano, Tex.; Robert R. Edison, Olympia Fields, Ill.

[73] Assignee: Atlantic Richfield Company, Los Angeles, Calif.

[22] Filed: June 2, 1975

[21] Appl. No.: 582,660

Related U.S. Application Data

[63] Continuation-in-part of Ser. No. 548,516, Feb. 10, 1975, abandoned.

[52] U.S. Cl. ..... 208/253; 208/251 H

[51] Int. Cl.[2] ..... C10G 29/04

[58] Field of Search ..... 208/253, 251 H, 91

[56] References Cited

UNITED STATES PATENTS

| | | | |
|---|---|---|---|
| 2,331,427 | 10/1943 | Schulze et al. | 208/135 |
| 3,183,178 | 5/1965 | Wolk | 208/251 H |
| 3,496,099 | 2/1970 | Bridge | 208/251 H |
| 3,663,434 | 5/1972 | Bridge | 208/216 |
| 3,817,855 | 6/1974 | Smith et al. | 208/253 |
| 3,819,509 | 6/1974 | Wolk et al. | 208/251 H |
| 3,876,533 | 4/1975 | Myers | 208/251 H |

*Primary Examiner*—Delbert E. Gantz
*Assistant Examiner*—James W. Hellwege
*Attorney, Agent, or Firm*—Roderick W. MacDonald

[57] ABSTRACT

Method of removing a contaminant, such as arsenic or selenium, from a synthetic hydrocarbonaceous fluid comprising providing a guard bed having a plurality of sections, a first section having from about 10 to about 75 percent of its volume occupied by a contaminant-removing material comprising, alone or on a carrier, either iron, cobalt, nickel, oxides or sulfides of these metals, or combinations thereof; the remainder being inert material. A second section of the guard bed has a major portion of its volume occupied by the contaminant-removing material. The feed oil, in the presence of hydrogen is contacted with the particles in the respective sections of the guard bed.

6 Claims, 2 Drawing Figures

METHOD OF REMOVING CONTAMINANT FROM A HYDROCARBONACEOUS FLUID

Cross References to Related Applications

This is a continuation-in-part of U.S. Pat. application Ser. No. 548,516, filed Feb. 10, 1975 now abandoned.

BACKGROUND OF THE INVENTION

1. Field of the Invention

This invention relates to a method of removing impurities or contaminants; such as, arsenic or selenium; from hydrocarbonaceous fluids, such as synthetic crude oil and fractions thereof.

1. Description of the Prior Art

There has been a resurgence of interest in sources of energy that were formerly not competitive. These sources of energy include shale oil, gasified and/or liquefied coal, bitumen from tar sands, and the like. Frequently, these fluids are lumped together under generic terms like "synthetic hydrocarbonaceous fluids," "synthetic crude oil," or "synthetic oil fractions." Some of these hydrocarbonaceous fluids contain contaminants that could reduce the activity of certain catalysts that are used in hydrogenation and other processes to which these hydrocarbonaceous fluids may be subjected before they are used as sources of energy. Even if such hydrocarbonaceous fluids are employed directly as fuels, the removal of contaminants may be desirable for environmental purposes. Consequently, it may sometimes be desirable to essentially remove or lower the concentration of such contaminants.

The prior art has included methods of removing arsenic from hydrocarbon charge stocks, such as described in U.S. Pat. No. 2,778,779. Such methods have included the using of iron, nickel and cobalt oxides to remove arsenic from streams of naturally occurring crude oil fractions; for example, naphtha or straight run gasoline. In that process, the oxides were employed at a low temperature, such as from room temperature to about 200° F, without regard to the atmosphere under which the reaction takes place and with substantial amounts of water, the oxide acting as an oxidizing agent and oxidizing the arsenic to a water soluble arsenic oxide. In this way, the arsenic oxide is dissolved in the water and removed from the naturally occurring crude oil or oil fraction.

Also, as disclosed in U.S. Pat. No. 2,781,297, arsenic has been removed from similarly naturally occurring crude oils by contacting them with a metallic salt of a strong acid at low temperature, such as room temperature, without regard to the atmosphere under which the contacting takes place. In this particular process, it was taught that oxides do not work for removing arsenic.

One of the most pertinent patents of which we are aware is U.S. Pat. No. 3,496,099, which describes the catalytic hydrogenation of hydrocarbons to effect the precipitation of an insoluble iron salt of the iron porphyrin within a hydrogenating catalyst that increases in concentration longitudinally and concurrently with the flow of the feed; the feed being naturally occurring hydrocarbons.

SUMMARY OF THE INVENTION

Accordingly, it is an object of this invention to provide a method of removing contaminants from a feed stream of synthetic hydrocarbonaceous fluid that does not require the use of aqueous, or hydrophilic, solutions, and alleviates the difficulties of the prior art.

More specifically, it is an object of this invention to provide a method of removing a contaminant from a feed stream that accomplishes the foregoing object and provides a stable guard bed that maintains a continuous high level of activity, yet can be operated with economically feasible equipment over a prolonged interval without plugging, particularly in the first part of the bed to be contacted.

These and other objects will become apparent from the descriptive matter hereinafter, particularly when taken in conjunction with the appended drawing.

The foregoing objects are achieved in accordance with this invention by the following multi-step process. First, the bed is prepared having a plurality of sections. At least one first section to be contacted by the hydrocarbonaceous fluid has from about 10 to about 75 percent of its volume occupied by a contaminant-removing material and has the remainder of its volume occupied by an inert material different from the contaminant-removing material. The bed is prepared to include at least one additional section having at least a major portion of its volume occupied by the contaminant-removing material for more nearly complete removal of contaminant from the hydrocarbonaceous feed containing same. The contaminant-removing material comprises either iron, cobalt, nickel, at least one oxide or sulfide of the named metals, or any combination thereof. The contaminant-removing material may comprise the named active materials alone; or preferably, carried on a strong carrier that maintains its structural integrity under the conditions of contact with the feed. Suitable carrier material includes silica, alumina, magnesia, zirconia, thoria, zinc oxide, chromium oxide, silicon carbide, naturally occurring carrier such as the clays, including special clay like Fuller's earth; Kieselguhr; pumice; bauxite and the like; combinations of two or more thereof, whether naturally occurring or prepared. Preferably, the carrier materials are specially treated or activated, to have at least one of high pore volume of at least 0.8 cubic centimeters per gram (cc/gm) with a major portion of pore radius greater than 100 Angstroms A, and feeder pores greater than 1,000 A in radii. In any event, the contaminant-removing material must be operable to effect deposition of the contaminant on and/or within the particles of the bed when contacted by the hydrocarbonaceous feed containing the contaminant. The contacting is normally under a reducing atmosphere, such as in the presence of hydrogen. The pressure can be ambient or elevated such as at least 500 psig. The temperature is also elevated, for example, at least about 300° F, preferably from about 300° to about 850° F. Next, a hydrocarbonaceous fluid having the contaminant therein and making up a portion of a feed stream is passed through the guard bed under a reducing atmosphere and the contact conditions delineated hereinbefore. The conditions of contact of the hydrocarbonaceous fluid having the contaminant with the contaminant-removing material includes a substantial absence of water such that the contaminant is deposited in the particles in a water insoluble form. By "substantially no water" or "substantial absence of water" is meant less than 1.0, preferably, less than 0.1, percent by weight of water in the synthetic oil, or hydrocarbonaceous fluid, to be treated. The admixture is flowed serially through the sections of the guard bed under the delineated conditions. Consequently, a minor portion of the contaminants in the hydrocarbonaceous fluid is removed therefrom and deposited over a major portion of the first section, instead of a high and flow blocking concentration in the first part of the section to be contacted. Similarly, the concentration of contaminant is reduced in the second and subsequent sections of the bed to an acceptably low level of contaminant under the delineated conditions of contact. For all sections in the bed, the conditions of contact comprise a pressure, temperature, and atmosphere as discussed hereinabove. The contaminant that is removed from the hydrocarbonaceous fluid is deposited over a major portion of the second section of the guard bed instead of a high and flow blocking concentration in the first part of the section to be contacted.

The manner in which the contaminants are removed from the hydrocarbonaceous fluid is not entirely clear. It is possible that the contaminant-removing material is involved as a catalyst in effecting a decomposition of organic compounds of the contaminants, such as organo-arsenic compounds. In any event solids, including the contaminant, such as arsenic, are deposited at least in part in the interstices, or voids, intermediate the particles. Also, analysis of the spent material employing iron oxide on a carrier material shows the presence of iron arsenide compounds, such as $FeAs_2$ and FeAs. Consequently, it appears clear that the active material is also involved as a reactant. In addition, it is possible that it acts as an adsorbent, since the arsenic in analyzed beds will show up, not only in the matrices of the structure, but deposited on the surfaces of the particles. Accordingly, the terminology of "effecting deposition of the contaminant within the material" will be employed to connote this apparently complex and inadequately explicable phenomena of the removal of the contaminant. It is sufficient to note, however, that the invention works whether the theories are correct or not and this invention is not to be limited to the consequences of any theory.

Preferably, the guard bed has more than two sections. One section to be contacted is a section that has its volume substantially completely occupied by contaminant-removing material.

If more nearly complete removal of the contaminant is desired, a small section of the bed adjacent the effluent end may be filled with a conventional hydrogenation catalyst.

DESCRIPTION OF PREFERRED EMBODIMENTS

Figure 1:
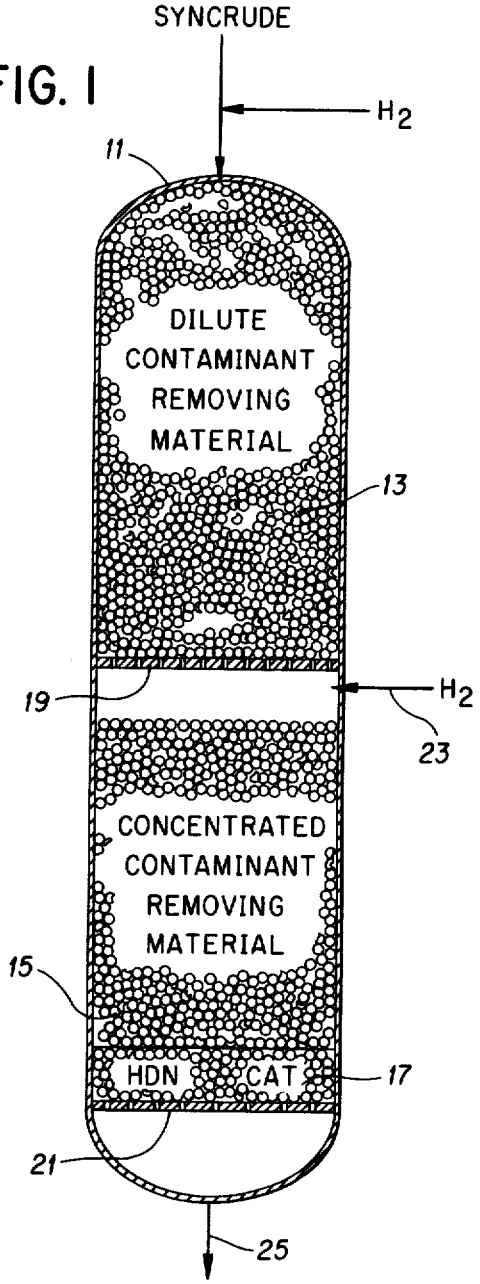
FIG. 1 is a partial schematic flow diagram of the process in accordance with this invention.

To facilitate understanding, the treatment of a stream of a synthetic crude oil, commonly referred to as syncrude, with the particles of contaminant-removing material for removing the contaminant will be described hereinafter.

In a discussion of this invention, reference to arsenic and selenium contaminants is intended to include those contaminants in the form of free, or elemental, forms; as well as those contaminants in any combined form.

In carrying out the invention as outlined hereinbefore, a guard bed is formed by depositing pellets, spheroidal particles, or other shaped particles, into a pressure vessel. The vessle is adapted to withstand the pressure and temperature necessary to effect the removal of the contaminant; arsenic or selenium, whether in elemental or combined form. The particles of material may have any shape and any of the sizes that are employable in this art. Specifically, the particles must not be so small as to pack into a flow blocking mass or so large as to render internal area of the particles of contaminant-removing material inaccessible to the fluid and contaminant. Ordinarily, the particles of material will comprise extrudates or pellets of from 1/32 to ¼ inch or more in diameter and one-eighth inch or more in length; or spheroidal particles within the diameter range of 1/32 to ¼ inch.

The contaminant-removing material may comprise active material, alone, or carried by a carrier material, as indicated hereinbefore. The active materials of the contaminant-removing material are delineated hereinbefore, also. As regards the oxides and sulfides of the metals set forth hereinbefore as the active material, the ferric, nickelic, cobaltic, ferrous, nickelous and cobaltous forms can be employed. For example, ferric oxides, both $Fe_2O_3$ and $Fe_3O_4$; nickelic oxides $Ni_2O_3$ and $Ni_3O_4$ and cobaltic oxides $Co_2O_3$ and $Co_3O_4$ can be employed. Similar reasoning is applicable to the comparable sulfides of the metals and to the ferrous, cobaltous and nickelous forms of the oxides and sulfides.

The particles of contaminant-removing material can have, for example, a surface area of at least 1 square meter per gram ($m^2/gm$), preferably at least 50 square meters per gram. Suitable carrier materials are available having high pore volume greater than 0.8; for example, 0.98 up to 1.5 cubic centimeters per gram; and having surface areas of from 240 to 360 square meters per gram. The contaminant-removing material can have feeder pores greater than 1,000 A in radii running therethrough for flow therethrough of the hydrocarbonaceous fluid and contaminant; and have active material disposed at least adjacent the pores for contacting the hydrocarbonaceous fluid and contaminant for effecting deposition of the contaminant within the contaminant-removing material and removal of the contaminant from the hydrocarbonaceous fluid feed. Two particularly suitable contaminant-removing materials comprise: (1) a co-precipitated catalyst having the material co-precipitated with and uniformly distributed throughout a carrier material, such as alumina; and (2) an active material carried by a high pore volume carrier material, such as gamma alumina, and having feeder pores running therethrough. It is sufficient to note herein that the latter material has feeder pores formed by admixing fillers, including carbon or an organic filler, such as cellulose fibers, before the particles of a material and carrier material are formed, as by extrusion of the pellets or dropping of spheroidal particles through a medium. The fillers are then burned away during calcination in an oxidizing atmosphere to leave the continuum of feeder pores. The feeder pores allow access of the hydrocarbonaceous fluid and contaminant to the interior portions of all the particles for best results. Any other material having the capability of effecting deposition of the contaminant in the interstices and in the particles of the contaminant-removing material and decreasing the concentration of the contaminant in the hydrocarbonaceous fluid feed stream may be employed in this invention as long as the particles of material are economically feasible.

The bed or respective sections thereof may be as large as needed to obtain the desired removal of the contaminant at predetermined flow rates of predetermined feeds. Expressed otherwise, the invention is not limited to size of the section.

The invention may be understood more clearly by referring to FIG. 1. Therein, a pressure vessel 11 is employed for the guard bed. The guard bed comprises a plurality of sections 13, 15 and 17. The first section 13 is labeled DILUTE CONTAMINANT-REMOVING MATERIAL, since the contaminant-removing material is diluted by inert material. Specifically, the first section 13 has only a minor portion of its volume occupied by the contaminant-removing material, and that is scattered throughout an inert material different from the contaminant-removing material; the inert material occupying a major portion of the volume of section 13. The contaminant-removing material particles are dispersed throughout the particles of inert material. This is advantageous in providing greater intersticial volume about each respective particle of contaminant-removing material for containing the deposited contaminant. This is surprisingly advantageous over the use of increasingly more catalytically active material, such as described in U.S. Pat. No. 3,496,099. The contaminant-removing material will be the active material, either alone or carried by a carrier material as delineated hereinbefore. The inert material should be stable at temperatures in excess of 850° F., should be inoperable to remove contaminant from the fluid being treated, and can be comprised of. alumina, silica, silica-alumina or inert ceramic packing, such as Raschig rings, beryl saddles or the like. The particles of inert material may comprise almost any size from about 1/32 inch up to about 3/16 inch; preferably about the same size as the contaminant-removing material. As indicated, the contaminant-removing material will comprise a proportion within the range of from about 10 to about 75; preferably, from about 20 to about 50; percent by weight of the total material occupying the volume within the section 13 of the vessel 11.

The particles of the materials may be emplaced on their own discrete supporting members; such as, foraminous, or perforate, support 19; or may rest upon the particles of material in lower sections, as illustrated by the second section 15.

The second section 15 is labeled CONCENTRATED CONTAMINANT-REMOVING MATERIAL, since it will have a major portion of its volume occupied by the contaminant-removing material for more nearly complete removal of the contaminants from a hydrocarbonaceous fluid feed stream flowing therepast. A plurality of concentrated contaminant-removing material sections may be employed. Each respective section may have increasing proportions of the contaminant-removing material with respect to the total materials contained therewithin; the remainder being particles of inert materials as described hereinbefore. Preferably, the last such section to be contacted in the guard bed will be comprised substantially completely of the contaminant-removing material, although it should be borne in mind that the contaminant-removing material itself may comprise a carrier carrying the active material. The same particle sizes delineated hereinbefore with respect to the contaminant-removing material in the first section 13 is also applicable with respect to the contaminant-removing material in the second section 15. Ordinarily, two sections 13 and 15 are adequate and prevent having to admix inert material in a plurality of sections in a plurality of different proportions.

The contaminant-removing material in the second section 15 is illustrated as being supported by the particles of hydrogenation catalyst in the third section 17 in FIG. 1.

The third section 17 contains particles of a conventional hydrogenation catalyst. Suitable hydrogenation catalysts include the cobalt-molybdenum catalysts, the less active nickel and tungsten on silica-alumina or alumina supports, nickel and molybdenum compounds on silica-alumina or alumina supports, or the cobalt and molybdenum compounds on comparable supports. The particles of the hydrogenation catalyst in the third section 17 lower the concentration of the contaminant in the hydrocarbonaceous fluid below a low level near zero that would otherwise poison a downstream catalyst employed to hydrogenate the hydrocarbonaceous fluid.

The hydrogenation catalyst is illustrated as being supported on its own foraminous or perforate support 21. As described hereinbefore, however, it could be rested on suitable inert material in the bottom of the vessel.

Referring to FIG. 1, the syncrude and the hydrogen ($H_2$) comprises two streams that are admixed and flowed into the vessel 11. The resulting admixture of syncrude and hydrogen contact the respective particles of material in the respective sections at temperatures greater than 300° F in the substantial absence of water, and a superatmospheric pressure where the hydrogen has a partial pressure of at least 500 psig; preferably, at least 1,000 psig. Preferably, also, the contacting of the hydrocarbonaceous fluid with the material is effected at a temperature in the range of 400°–850° F. Preferably, the fluid streams are heated upstream of the vessel 11 by conventionally employed heaters, such as directly fired or indirectly fired heat exchangers. The contacting is effected at a reaction severity sufficient to achieve the desired removal of the contaminant. One variable of reaction severity may be expressed in "space time" or its reciprocal "weight hourly space velocity" (WHSV). Herein, such reaction severity is, for example, from about 100 WHSV to about 2 WHSV. The weight hourly space velocity is the rate of flow in weight per hour of hydrocarbonaceous fluid divided by the weight of contaminant-removing material in the bed. At lower WHSV's the breakthrough of a contaminant may be delayed until the bed, or sections, of particles of material, is more nearly completely used up; whereas at high WHSV's, the contaminant may breakthrough (as hereinafter defined) before the capacity of the bed is reached. The desired atmosphere is provided by molecular hydrogen being present as the feed contacts the particulate material in the respective sections.

In any event, the contacting of the heated admixture with the particles of material is effected within the respective sections. The process of removing the contaminant from the syncrude is slightly exothermic so the temperature tends to increase slightly within the vessel.

Only a minor proportion of the contaminant is removed from the hydrocarbonaceous fluid in the dilute contaminant-removing material section 13. The contaminant is desposited throughout a major portion of the material (both inert and contaminant-removing) in the first section 13.

As the hydrocarbonaceous fluid flows out of the first section 13 and into the second section 15, additional hydrogen may be admixed therewith, as indicated by the side stream 23. The additional hydrogen may be heated to a higher temperature to raise the temperature of the contacting.

Surprisingly, the contaminant is deposited substantially within the particles throughout the second section 15, rather than primarily in the interstices outside the particles in the first section to be contacted. While again this invention is not to be limited to the consequences of any theory, it is theorized that the more reactive contaminant, which reacts so rapidly in the first section of the bed that it is deposited primarily externally of the particles, will have been removed by the first section 13. The remaining contaminant reacts more slowly in the second section 15 and deposits primarily within the particles.

In any event, the contaminant is removed to a concentration at an acceptably low level near zero in the second section 15. Ordinarily, the second section 15 will be adequate in the guard bed inside the pressure vessel 11, obviating the necessity for the third section 17. The third section 17 is a good way of ensuring the removal of substantially all of the contaminant.

The materials in the guard bed, or vessel 11, are exposed to a predetermined amount of feed to be treated, based on empirical data. The feed is then routed to another guard chamber containing fresh material for treating the feed.

If desired, instead of merely flowing a predetermined quantity of feed through a guard bed and then switching, the switching can be made at "breakthrough" of the contaminant. In determining breakthrough, an effluent stream of treated feed, such as in stream 25, is monitored to maintain the concentration of the contaminant below a predetermined acceptable level near zero; and breakthrough is indicated by the concentration of the contaminant approaching that predetermined acceptable level.

In any event, spent material in a first guard bed is removed or regenerated in situ after the stream is switched therefrom.

If removed, fresh material is emplaced in the first guard bed as a replacement for the spent material. If regenerated, it is ready for another cycle. The cycles are continued as necessary to effect the desired treatment.

Referring again to FIG. 1, the effluent stream 25 of the syncrude without the intolerably high concentration of a contaminant therein and the hydrogen are then transported by a suitable conduit to any other vessel, such as a hydrogenation reactor (not shown). In the hydrogenation reactor, hydrogenation conditions may be employed in accordance with conventional practice, but experience has shown that most syncrudes are substantially different in nature from naturally occurring crudes and, therefore, require a unique hydrogenation process as well as a unique contaminant removal process.

Other Embodiments

Figure 2:
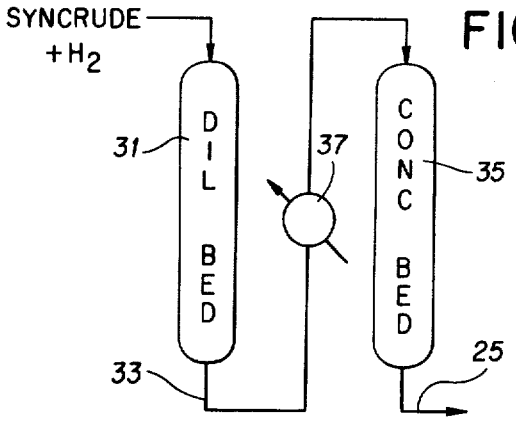
FIG. 2 is a schematic view of another embodiment of this invention.

While a single bed comprising a plurality of sections has been described hereinbefore as the preferred embodiment of this invention, each section may, in fact, comprise a discrete bed employing relatively smaller and less expensive vessels for greater flexibility in operating conditions. This allows changing out of individual beds and switching through other beds as needed and does not require care in designing the size of the sections and the concentration of the contaminant-removing material such that each section is used up at substantially the same time. For example, as illustrated in FIG. 2, the incoming stream of syncrude plus hydrogen ($H_2$), is fed to the dilute contaminant-removing material in a first bed 31 (labeled DIL BED for shorthand connotation). The syncrude and hydrogen contact the particles of material, including the contaminant-removing material and the inert material, similarly as described with respect to first section 13 and FIG. 1. As described with respect thereto, a minor proportion of the contaminant is removed and deposited throughout a major portion of the dilute bed, or the particles of dilute contaminant-removing materials. The effluent stream in conduit 33 is then passed to the concentrated contaminant-removing material (labeled CONC BED) 35. The particles of material in the concentrated bed 35 are the same as those described hereinbefore with respect to the second section 15 in the vessel 11. Similarly as described hereinbefore, the concentration of the contaminant is lowered to an acceptably low level near zero.

If desired, the bottom portion of the concentrated bed 35 may comprise hydrogenation catalyst, similarly as described hereinbefore with respect to the third section 17 in the vessel 11 of FIG. 1. The temperature and pressure of contact employed in the respective beds 31 and 35 are the same as those delineated hereinbefore with respect to FIG. 1. The effluent stream 25 is handled similarly as described hereinbefore with respect to FIG. 1.

Employing a single bed is advantageous from the standpoint of having to change out fewer beds, however, and the respective sections can be sized by an engineer based on empirical data.

In addition to varying the proportion of the contaminant-removing material to inert material in respective sections, or beds, the temperature of contact in the respective sections or beds may be varied also to introduce additional flexibility. For example, the dilute contaminant-removing material in the dilute bed 31, FIG. 2, may be contacted at a first relatively low temperature in the range of from about 300° to about 550° F whereas the temperature is raised, as by heat exchanger 37 such that the contacting in the concentrated bed 35 is effected at a temperature greater than the first, low temperature and in the range of from about 550° to about 850° F. The use of both the diluted contaminant-removing material in the dilute bed 31 and the lowered temperature imparts a degree of flexibility that allows matching the capacity of the respective beds 31 and 35 such that they can be changed out simultaneously or substantially so.

General Information

Either before, after, or before and after a feed is contacted with the material above described for contaminant removal, the feed can be treated in other known ways for removal of one or more of the above-identified contaminants. The feed can be pre-treated for partial removal of contaminants before the feed is treated in accordance with this invention. After treatment of the feed in accordance with this invention, the feed can be further treated for clean-up removal of the contaminants if desired.

One suitable method than can be practiced in conjunction with this invention is conventional caustic washing. For example, one way to carry out caustic washing is to contact the liquid feed with an aqueous solution of at least one alkali metal hydroxide, such as sodium hydroxide and potassium hydroxide, the hydroxide or combination of hydroxides being present in an amount of from 1 to about 20 weight percent based on the total weight of the aqueous solution. The caustic solution is contacted with the hydrocarbonaceous fluid, or feed, in a solution-feed weight ratio of about 1:1 to about 1:10, the contacting being carried out at a temperature of about 200° F, preferably at least 300° F, with the pressure being maintained sufficient to prevent substantial vaporization of oil and the like; for example, at least about 300 psig. The atmosphere present during contacting with caustic solution can be ambient, although if desired, neutral and/or reducing atmospheres can be employed but are not necessary. After treatment, the aqueous solution is separated from the hydrocarbonaceous fluid by conventional methods, such as employing a settling tank followed by a centrifuge and the like. The hydrocarbonaceous fluid after treating with the caustic solution must be washed with water or other suitable solvent to remove residual caustic solutions and any impurities associated with that solution.

If a contaminant separation process is employed prior to the method of this invention and that process employs water in some manner, substantially all of the water can be removed from the feed before carrying out the method of this invention. Removal of absolutely all of the water is not necessary, since the method of this invention is not deleteriously affected by the presence of water, but neither does the method of this invention require the presence of water to be operable or to act as a processing aid.

The following Example is included to illustrate a run employing a high pore volume, feeder pore, iron on alumina contaminant-removing material. The contaminant-removing material is prepared by doubly impregnating iron nitrate onto gamma alumina having feeder pores running therethrough, prepared in accordance with U.S. Pat. No. 3,429,660 and U.S. Pat. No. 3,558,508. Specifically, an aqueous iron nitrate solution is doubly impregnated into the carrier and is calcined at 900° F, for 1 hour to form a high pore volume, feeder pore iron on alumina contaminant-removing material with the iron oxide dispersed adjacent the pores throughout the matrix of the carrier material for intimate contact with the hydrocarbonaceous fluid and contaminant flowed past the particles. The particles were extrudates having diameters of about one-sixteenth inch and lengths of about one/eighth inch. The contaminant-removing material has about 23 percent by weight iron oxide on an alumina carrier that has a high pore volume of about 0.98 cubic centimeters per gram and a surface area of about 258 square meters per gram.

The hydrocarbonaceous feed is a gas oil derived from oil shale and has a boiling point range of 400°–950° F and having 45 parts per million (ppm) arsenic therein.

In the runs, the test condition is designed to be representative of 7.5 foot internal diameter guard bed. The conditions are 1.4 pounds per second per square foot (lb/sec. sq. ft.) of oil feed and a hydrogen flow of 4,000 standard cubic feet per barrel (SCFB). Specifically, ½ inch reactors are charged with 20 grams of a cobalt-molybdenum hydrogenation catalyst to form a third section 17; a second section comprising about 64 grams of the contaminant-removing material and a top, of first section 13, comprising 32 grams of the contaminant-removing material substantially uniformly dispersed in 64 grams of the alumina carrier. The reactor is welded into a lead bath pipe. The unit is pressure checked at 2,200 psig. The oil is fed and the product put in a clean barrel. A pressure check is run on the reactor. The reactor is pressured to 2,000 psig with a hydrogen flow of 40.3 standard cubic feet per hour. The oil is circulated at 3.2 pounds per hour (1,450 grams per hour). The temperature is 700° F.

Breakthrough is noted by the presence of 7 ppm. arsenic in the effluent stream from the guard bed.

The pressure drop across the guard bed is measured. The pressure build up at breakthrough is less than 50 psig; whereas in a single section, undiluted bed, a pressure drop of 450 psig was experienced in a much shorter time of operation. The bed is sectioned and inspected. The contaminant is distributed primarily in the interstices in the first section and primarily within the particles in the second section.

Although the operation of this invention has been described hereinbefore with respect to syncrude, it should be borne in mind that the invention is operable on any hydrocarbonaceous feed that has been obtained by liquefying and/or gasifying each of the normally solid coal, normally solid kerogen in oil shales or the normally solid-like hydrocarbonaceous portions of tar or tar sands.

From the foregoing, it can be seen that this invention accomplishes the objects delineated hereinbefore.

Having thus described this invention, it will be understood that such description has been given by way of limitation and example and not by way of limitation, reference to the latter purpose being had to the appended claims.

What is claimed is:

1. A method of removing a contaminant comprising at least one of arsenic and selenium from a synthetic hydrocarbonaceous fluid containing same comprising a. preparing a guard bed having a plurality of sections; at least one section which is to be contacted by said fluid and contaminant first having from about 10 to about 75 percent by volume occupied by a contaminant-removing material composed of a carrier material carrying active material, the remainder being essentially an inert material different from said contaminant-removing material; said contaminant-removing material being particulate and consisting essentially of a material selected from the group consisting of iron, cobalt, nickel, at least one oxide thereof, at least one sulfide thereof, and combinations of two or more thereof; said inert material being stable at temperatures in excess of 850° F and inoperable to remove said contaminant from said fluid; said guard bed having a least one additional section having its volume substantially completely occupied by said contaminant-removing material for additional removal of contaminant from said hydrocarbonaceous fluid;

b. flowing said hydrocarbonaceous fluid through said first section of said guard bed under a reducing atmosphere, in the substantial absence of water, and an elevated temperature of from about 300° to about 550° F to effect a reduction in the concentration of said contaminant in said hydrocarbonaceous fluid and deposition of said contaminant in said first section of said guard bed; and, thereafter, c. flowing the hydrocarbonaceous fluid reduced in said contaminant into contact with said at least one additional section of said guard bed under essentially the same conditions as step b. above except that the temperature in said at least one additional section is higher than the temperature in said first section and from about 550° to about 850° F to effect a further reduction of the concentration of said contaminant.

2. The method of claim 1 wherein said contaminant-removing material comprises a plurality of particles of a carrier material selected from the group consisting of silica, alumina, magnesia, zirconia, thoria, zinc oxide, chromium oxide, clay, Keiselguhr, Fuller's earth, pumice, bauxite and combinations of two or more thereof; said carrier material carrying an active material as defined in claim 1; said carrier material having a pore volume of at least 0.8 cubic centimeters per gram and a surface area in excess of 100 square meters per gram and having feeder pores having radii greater than 1,000 angstroms disposed therethrough for allowing said hydrocarbonaceous fluid and said contaminant to contact substantially all of said active material; said active material being disposed at least adjacent said pores.

3. The method of claim 2 wherein said carrier material is alumina and said active material is selected from the group consisting of an oxide of iron, a sulfide of iron, and combinations thereof.

4. The method of claim 2 wherein said guard bed includes at least one terminal section that has substantially all of its volume occupied by said contaminant-removing material.

5. The method of claim 1, wherein said guard bed includes more than two sections; at least one of said sections being a terminal section that is disposed at the downstream end of said bed so as to be the last section to be contacted by said hydrocarbonaceous fluid; said terminal section includes a plurality of particles of hydrogenation catalyst for substantially complete removal of said contaminant from said hydrocarbonaceous fluid.

6. The method of claim 5 wherein at least one of said terminal sections has substantially all of its volume occupied by said contaminant-removing material.

* * * * *